US009493988B2

(12) United States Patent
Phillips

(10) Patent No.: US 9,493,988 B2
(45) Date of Patent: Nov. 15, 2016

(54) STRING SUPPORTED WHIPSTOCK FOR MULTIPLE LATERALS IN A SINGLE TRIP AND RELATED METHOD

(71) Applicant: Baker Hughes Incorporated, Houston, TX (US)

(72) Inventor: Ronald D. Phillips, Buena Park, CA (US)

(73) Assignee: Baker Hughes Incorporated, Houston, TX (US)

( * ) Notice: Subject to any disclaimer, the term of this patent is extended or adjusted under 35 U.S.C. 154(b) by 780 days.

(21) Appl. No.: 13/782,371

(22) Filed: Mar. 1, 2013

(65) Prior Publication Data

US 2014/0246241 A1 Sep. 4, 2014

(51) Int. Cl.
*E21B 7/06* (2006.01)

(52) U.S. Cl.
CPC ..... *E21B 7/061* (2013.01)

(58) Field of Classification Search
CPC .. E21B 41/0035; E21B 23/002; E21B 29/06; E21B 7/061; E21B 10/64
See application file for complete search history.

(56) References Cited

U.S. PATENT DOCUMENTS

| | | | | |
|---|---|---|---|---|
| 2,770,444 | A | 11/1956 | Neal | |
| 5,318,132 | A | 6/1994 | Odorisio | |
| 5,335,737 | A | 8/1994 | Baugh | |
| 5,398,754 | A | 3/1995 | Dinhoble | |
| 5,427,179 | A | 6/1995 | Bailey et al. | |
| 5,467,819 | A | 11/1995 | Braddick | |
| 5,474,126 | A | 12/1995 | Lynde et al. | |
| 5,535,822 | A | 7/1996 | Schock et al. | |
| 5,758,723 | A * | 6/1998 | Saucier | E21B 23/04 166/241.6 |
| 5,769,167 | A * | 6/1998 | Braddick | E21B 7/061 166/117.6 |
| 5,871,046 | A * | 2/1999 | Robison | E21B 7/061 166/117.6 |
| 5,909,770 | A | 6/1999 | Davis | |
| 6,047,774 | A * | 4/2000 | Allen | E21B 7/061 166/117.5 |
| 6,073,691 | A | 6/2000 | White | |
| 6,076,606 | A | 6/2000 | Bailey et al. | |
| 6,109,347 | A | 8/2000 | Ferguson et al. | |
| 6,360,821 | B1 | 3/2002 | Braddick | |
| 7,178,589 | B2 | 2/2007 | Campbell et al. | |
| 7,448,446 | B2 | 11/2008 | Campbell et al. | |
| 2001/0041963 | A1* | 11/2001 | Estes | G01C 19/38 702/6 |
| 2004/0112603 | A1* | 6/2004 | Galloway | E21B 7/061 166/358 |
| 2006/0169495 | A1* | 8/2006 | Kolle | E21B 7/06 175/61 |
| 2009/0255676 | A1* | 10/2009 | Peters | E21B 4/18 166/298 |
| 2010/0193192 | A1* | 8/2010 | Buckman, Sr. | E21B 29/06 166/298 |

* cited by examiner

*Primary Examiner* — Robert E Fuller
*Assistant Examiner* — David Carroll
(74) *Attorney, Agent, or Firm* — Steve Rosenblatt

(57) ABSTRACT

A whipstock is supported adjacent the lower end of a string during the drilling of the lateral. It has no integrated anchor. The BHA is delivered through the string that supports the whipstock. After a lateral is drilled the BHA is retracted and the support string is manipulated to advance the whipstock to a new location for proper orientation with a gyroscopic tool. The BHA is then advanced through the support string for drilling of another lateral in the same trip in the hole. The process can be repeated as many times as needed. Peripheral pads on the lower end of the whipstock push the lower end of the whipstock ramp to the borehole wall for proper tracking of the lateral. The laterals can be in open or cased hole and the support string can have circulation ports near the whipstock to cool the BHA in geothermal wells.

18 Claims, 1 Drawing Sheet

STRING SUPPORTED WHIPSTOCK FOR MULTIPLE LATERALS IN A SINGLE TRIP AND RELATED METHOD

FIELD OF THE INVENTION

The field of the invention is forming laterals in an existing wellbore and more particularly where the bottom hole assembly (BHA) is run through a string to support a whipstock so that multiple laterals can be created in a single trip.

BACKGROUND OF THE INVENTION

Traditional systems and methods for making laterals in existing boreholes typically require a separate run to deliver, orient and set a whipstock so that the lateral can be drilled. If multiple laterals are contemplated in a main bore the BHA is removed and another run is needed to tag the whipstock and release its anchor so that the whipstock can be removed and another assembly of a whipstock and BHA can be run into a new location and the whipstock oriented and anchored so that the next lateral can be drilled.

Whipstocks with integrated anchors are illustrated in U.S. Pat. Nos. 7,448,446; 7,178,589; 6,109,347 and 6,360,821. Retrievable whipstocks allow the anchor to be released so that the whipstock can be removed after a single use. Such designs are illustrated in U.S. Pat. Nos. 5,335,737; 5,909,770; 5,427,179; 5,871,046; 5,398,754; 6,073,691; 5,474,126; 5,535,822; 6,076,606; 2,770,444; 5,467,819 and 5,318,132.

In some applications there is a need to drill multiple laterals at different depths and orientations with respect to a main bore in succession to control rig time and hence the cost of drilling the laterals. Existing techniques involve multiple trips to remove whipstocks and to replace another whipstock with a BHA at the new lateral location after finishing a previous lateral. The apparatus and method of the present invention saves trips and rig time in such situations. The whipstock is supported at an uphole end with a delivery string that has an open lower end. The BHA is run into the delivery string and onto the whipstock ramp for drilling the lateral. The BHA is then removed from the lateral and into the delivery string and the delivery string is then moved and oriented at another location and the BHA is advanced and rotated and moves along the whipstock face for making another lateral in the same trip. The whipstock has no need for an anchor as the string from the surface suspends the whipstock at the needed locations and allows a gyroscopic tool in the BHA to properly orient the whipstock ramp. Pads are disposed opposite the whipstock ramp to push the whipstock laterally to get the lower end of the whipstock ramp against the borehole wall. These and other features of the present invention will be more readily apparent to those skilled in the art from a review of the detailed description of the preferred embodiment and the associated drawings while recognizing that the full scope of the invention is to be found in the appended claims.

SUMMARY OF THE INVENTION

A whipstock is supported adjacent the lower end of a string during the drilling of the lateral. It has no integrated anchor. The BHA is delivered through the string that supports the whipstock. After a lateral is drilled the BHA is retracted and the support string is manipulated to advance the whipstock to a new location for proper orientation with a gyroscopic tool. The BHA is then advanced through the support string for drilling of another lateral in the same trip in the hole. The process can be repeated as many times as needed. Peripheral pads on the lower end of the whipstock push the lower end of the whipstock ramp to the borehole wall for proper tracking of the lateral. The laterals can be in open or cased hole and the support string can have circulation ports near the whipstock to cool the BHA in geothermal wells.

DETAILED DESCRIPTION OF THE PREFERRED EMBODIMENT

Figure 1:
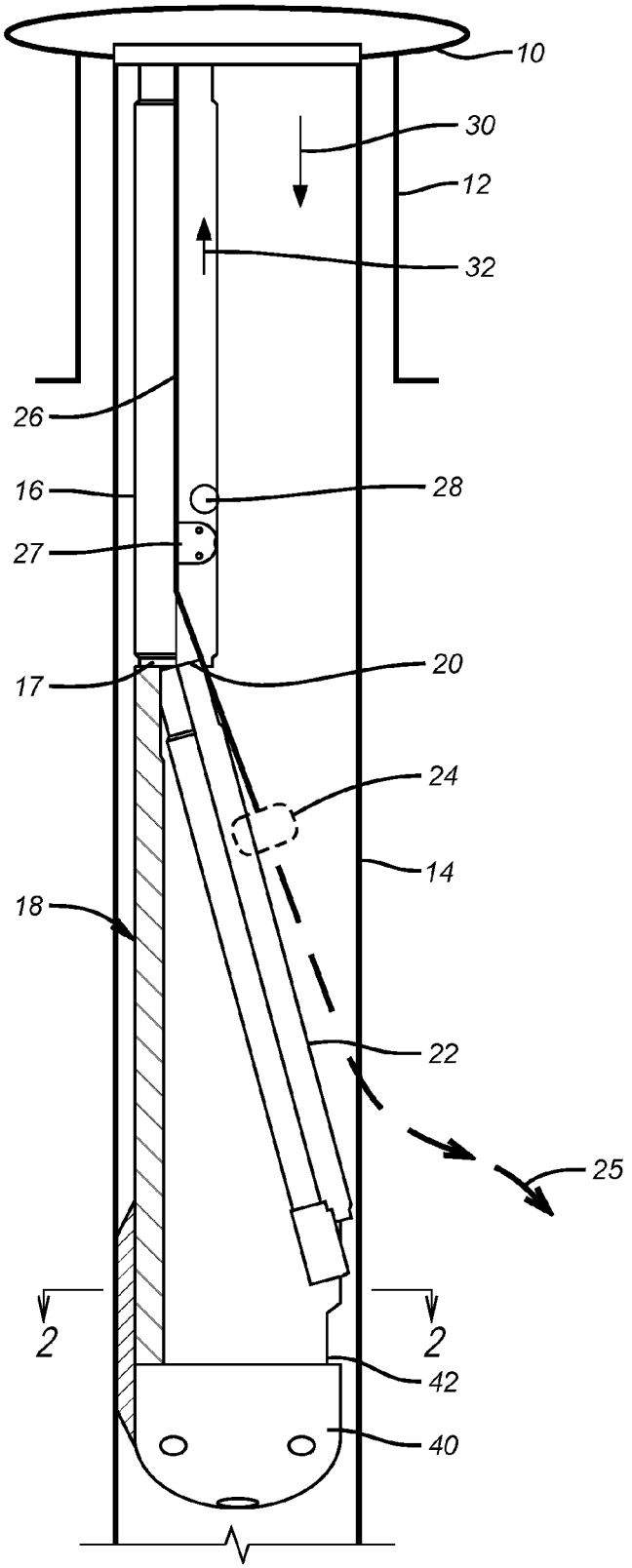
FIG. 1 is an elevation view of the whipstock in position for drilling at least one lateral.
Figure 2:
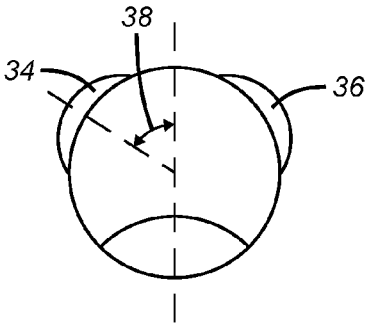
FIG. 2 is a section view along line 2-2 of FIG. 1.

FIG. 1 schematically illustrates a wellhead 10 that has an upper segment 12 that is cased. The borehole 14 is preferably a monobore open hole that is somewhat smaller than the upper segment 12 inside diameter. A support string 16 supports a whipstock 18 from adjacent the upper end 20 of the whipstock 18. The whipstock 18 has a ramp assembly 22 that can be a single or multiple slopes at different angles with intervening segments of no slope. The face of the ramp is preferably a trough to assist in tracking of the bottom hole assembly or BHA that is schematically represented by a dashed circle 24 that is delivered on a string 26. The BHA is known in the art to include a series of mills in cased holes or a drill bit in open hole among other tools, is advanced or retracted through the lower open end 17 of support string 16. String 26 can be rigid or coiled and if coiled tubing is used the BHA can have a downhole motor to drive the bit at the lower end of the BHA 24. The support string 16 has an orienting lug 27 that can interact with a gyroscopic tool in the BHA 24 for orientation of the whipstock ramp assembly 22. One or more ports 28 are preferably located near the upper end 20 of the whipstock 18 so that a reverse circulation path denoted by arrows 30 and 32 can be used during drilling a lateral to cool the BHA 24 when drilling in ultra deep geothermal wells to protect the BHA 24 components from excessive temperatures during drilling of the laterals. Pads such as 34 and 36 can be disposed generally opposite the ramp assembly 22 and the preferred quantity is two pads with an offset angle denoted by arrow 38 that is preferably in the range of 30-45 degrees from an axis that bisects the ramp assembly 22. A bull nose 40 is disposed on the lower end 42 of the whipstock 18.

The significant components now having been described, the method of the present invention will be explained in more detail. The whipstock 18 is positioned at the desired initial location in the borehole 14 while supported from the support string 16. The BHA 24 can be run together with the support string when locating the whipstock 18. The BHA 24 has a gyroscopic tool that interacts with the orientation lug 27 so that the support string 16 can be rotated as desired until the proper orientation for the ramp assembly 22 is achieved. Optionally for very high well temperatures reverse circulation going down outside the support string 16 as represented by arrow 32 and going through openings 28 and up inside an annular space in the support string 16 outside of string 26 can help keep the BHA 24 from exposure that can damage some of the more sensitive components such as MWD instrumentation. With the whipstock suspended from above and properly oriented, the BHA 24 is advanced as the lateral is drilled, as represented by arrow 25. When the lateral is completed the BHA 24 is retracted preferably into the support string 16 so that the support string 16 can be manipulated to reposition the whipstock 18 and to reorient the whipstock 18 in the same trip so that the drilling of another lateral can be started in the same trip. The process can be repeated as many times as necessary in a single trip within the limit of the drill bit to drill laterals.

The technique works in open hole or cased or lined hole. The pads 34 and 36 keep the lower end of the ramp assembly 22 at the borehole wall to stabilize the whipstock as the lateral is started and to assure a proper exit angle for the lateral with respect to the main bore.

In one application, multiple laterals can be drilled for a geothermal well that can then have tubes entering and exiting each lateral to allow for circulation and heating up of a fluid that can be flashed at the surface to drive turbines that drive generators to produce electric power. While a geothermal well is the preferred embodiment the technique has other application in cased or lined hole or in open hole and is not limited to a monobore main bore.

It should be noted that there is no support for the whipstock below the ramp when the lateral is being drilled. This makes it easy to reposition the whipstock for another lateral because an anchor is not used. Known anchors have a release feature that prevents them from being reset. Some of the designs of through tubing anchors require large radial extensions to anchor in a larger bore with some designs using long extension linkages that can be problematic for grip or for release. The elimination of an anchor below the whipstock ramp simplifies the design and allows the drilling of multiple laterals in a single trip. The ability of protecting the BHA for run in by having it inside the support string adds to reliability and allows for rapid redeployment of the whipstock with the BHA retracted into the support string. The BHA is simply re-extended onto the whipstock ramp assembly after the whipstock is deployed at a different location and reoriented. Pads opposite the whipstock ramp assembly push the lower end of the whipstock ramp assembly to the borehole wall to assure a proper exit angle for the lateral as the BHA leaves the whipstock when making the lateral. The laterals do not necessarily have to start from a main bore as the invention also contemplates drilling laterals from other laterals as well.

The above description is illustrative of the preferred embodiment and many modifications may be made by those skilled in the art without departing from the invention whose scope is to be determined from the literal and equivalent scope of the claims below:

I claim:

1. A one trip assembly for drilling at least one lateral in a single trip, comprising:

a whipstock comprising a ramp assembly and supported axially above said ramp assembly on a tubular support string for selective borehole movement;

a bottom hole assembly relatively movable with respect to said tubular support string for engaging said whipstock to drill at least one lateral in a single trip of said bottom hole assembly;

said tubular support string comprising at least one wall opening adjacent a lower end thereof and axially above said ramp assembly to allow reverse circulation going downhole outside the tubular support string to come back uphole inside said tubular support string to cool said bottom hole assembly.

2. The assembly of claim 1, wherein:

said bottom hole assembly extends through said tubular support string.

3. The assembly of claim 1, wherein:

said ramp assembly above a lower end thereof and is exclusively axially supported above said ramp assembly.

4. The assembly of claim 3, wherein:

said whipstock comprises at least one pad having an opposed orientation to said ramp assembly such that the presence of said at least one pad offsets said ramp assembly laterally toward a wall that defines the main bore.

5. The assembly of claim 1, wherein:

said support string has an open lower end adjacent said whipstock.

6. The assembly of claim 5, wherein:

said bottom hole assembly comprises a string and a bit that selectively pass through said open lower end.

7. The assembly of claim 1, wherein:

said support string rotates said whipstock to a desired orientation for a ramp assembly thereon.

8. The assembly of claim 1, wherein:

said support string further comprises a orientation lug to interact with the bottom hole assembly for provision of information to a surface for the main bore as to the orientation of a ramp assembly on said whipstock.

9. The assembly of claim 1, wherein:

said bottom hole assembly selectively positioned within said support string for movement of said whipstock axially in the main bore to a location for making an additional lateral in the same trip.

10. A method of drilling laterals from a main bore, comprising:

delivering a whipstock comprising a ramp assembly with a support string connected axially above said ramp assembly to at least one desired location;

advancing a bottom hole assembly relatively to said support string and onto said whipstock;

cooling the bottom hole assembly through at least one wall opening in the support string, said wall opening located axially above said ramp assembly by flowing fluid downhole outside the support string and through said opening and back uphole inside the support string;

drilling at least one lateral.

11. The method of claim 10, comprising:

supporting said whipstock against axial movement exclusively with said support string during said drilling.

12. The method of claim 10, comprising:

retracting said bottom hole assembly from said lateral after said drilling;

repositioning said whipstock to another location in the main bore with said support string;

drilling an additional lateral in the same trip.

13. The method of claim 10, comprising:

moving said bottom hole assembly through said support string for engagement with said whipstock.

14. The method of claim 10, comprising:

providing at least one pad on said whipstock located generally opposed to a ramp assembly on said whipstock whose presence shifts a lower end of said ramp assembly to a wall defining the main bore.

15. The method of claim 10, comprising:

providing an orientation lug on said support string;

using said bottom hole assembly and said lug to transmit orientation of a ramp assembly on said whipstock to a remote location;

selecting a desired orientation of said ramp assembly with rotation of said support string.

16. The method of claim 10, comprising:

repeating said delivering, advancing and drilling multiple times from a main borehole to make a plurality of laterals in a single trip.

17. The method of claim 16, comprising:

creating said laterals in a geothermal well.

18. The method of claim 10, comprising:

providing an open lower end for said support string adjacent a ramp assembly on said whipstock;

advancing the bottom hole assembly through said open lower end and onto said ramp assembly for said drilling of said lateral;

retracting said bottom hole assembly into said open lower end to facilitate repositioning of said whipstock for an additional lateral.

* * * * *